US006726198B2

(12) United States Patent
Glemser et al.

(10) Patent No.: US 6,726,198 B2
(45) Date of Patent: Apr. 27, 2004

(54) DEVICE FOR ALIGNING SHEETS OF PRINTED MATERIALS

(75) Inventors: Gerhard Glemser, Stuttgart (DE); Jürgen Ries, Ostfildern (DE); Joachim Schneider, Ostfildern (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 109 days.

(21) Appl. No.: 10/054,392

(22) Filed: Jan. 22, 2002

(65) Prior Publication Data

US 2002/0096822 A1 Jul. 25, 2002

(30) Foreign Application Priority Data

Jan. 23, 2001 (DE) ..... 101 02 812

(51) Int. Cl.[7] ..... B65H 29/66

(52) U.S. Cl. ..... 271/65; 271/184; 399/107; 400/692

(58) Field of Search ..... 271/184, 185, 271/186, 65; 399/364, 107, 110; 400/692

(56) References Cited

U.S. PATENT DOCUMENTS 4,602,775 A * 7/1986 Calhoun et al. ..... 270/58.05
4,787,616 A 11/1988 Sasaki
4,935,786 A * 6/1990 Veeder ..... 399/401
5,028,965 A 7/1991 Kinoshita
5,131,649 A 7/1992 Martin et al.
5,151,735 A * 9/1992 Yamashita et al. ..... 399/18
2002/0066995 A1 * 6/2002 Stoll ..... 271/186

FOREIGN PATENT DOCUMENTS

DE 298 07 321 U1 9/1998
EP 04 18 086 A2 3/1991
EP 0 494 108 A2 7/1992
EP 0 494 108 A2/3 7/1992

OTHER PUBLICATIONS

German Patent Application 101 02 812.1 Search Report.
European Search Report.
English Translation of relevant portions of European Search Report.
English Translation of Priority Document 101 02 812.1 DE.

* cited by examiner

*Primary Examiner*—Donald P. Walsh
*Assistant Examiner*—Kenneth W Bower
(74) *Attorney, Agent, or Firm*—Kevin L. Leffel

(57) ABSTRACT

The invention is in the field of aligning sheets of printed materials, of the type that aligns sheets of printed materials for a desired output, for example, from a finishing device. According one aspect of the invention, an alignment device is provided configured as a separate, replaceable unit. According to a further aspect of the invention, an alignment device and process are provided wherein a sheet is inverted about one or both axes.

17 Claims, 3 Drawing Sheets

DEVICE FOR ALIGNING SHEETS OF PRINTED MATERIALS

The invention is in the field of aligning sheets of printed materials, of the type that aligns sheets of printed materials for a desired output, for example, from a finishing device.

Devices for aligning flexible sheets of printed materials bearing images and text of the type mentioned above are known.

EP 0 494 108-A2 mentions an alignment unit as a stationary component of a copier for turning sheets of printed materials for the purpose of double-sided (duplex) copying, one-sided color highlight copying and alignment of sheets of printed materials according to the requirements of a separate downstream finishing device (finisher). The aligning unit or turning unit has a pocket mounted at a right angle to the upper and lower guideways of the copier, with a first end running into the upper guideway of the copier and a second end running into the lower guideway of the copier. In the area of the first end of the pocket and of the upper guideway, several side-by-side mounted, driven transport rollers and a controllable two-way distributing guide are mounted, by means of which sheets of printed materials bearing a toner image coming from the copier are transported into the pocket and, out of it, either back to the copier or to the external finishing device. In this process, the pocket can be swiveled or moved laterally so that the sheets of printed materials located in the pocket are guided, by means of through-feed transport rollers mounted in the pocket guideway, between the respective transport rollers over the top end of the pocket.

While the upper transport rollers have a specified uniform turning direction, the direction of rotation of the through-feed transport rollers located in the pocket is reversible. Besides that, sheets of printed materials can be conveyed by means of the through-feed transport rollers from the lower guideway of the copier to the upper sheet guideway and vice versa. In addition, sheets of printed materials can be transported directly to the external finishing device by means of the distributing guide and the transport rollers of the upper guideway.

SUMMARY

The invention is directed to improved alignment apparatus and processes for inverting printed sheets.

DETAILED DESCRIPTION

Various aspects of the invention are presented in FIGS. 1–4, which are not drawn to scale, and wherein like parts in the numerous views are numbered alike. In the preferred embodiment presented herein, the invention is described as part of a printing apparatus that includes a xerographic printing device. However, the invention is not so limited, as other arrangements and other printing devices are possible and contemplated in the practice of the invention.

Figure 1:
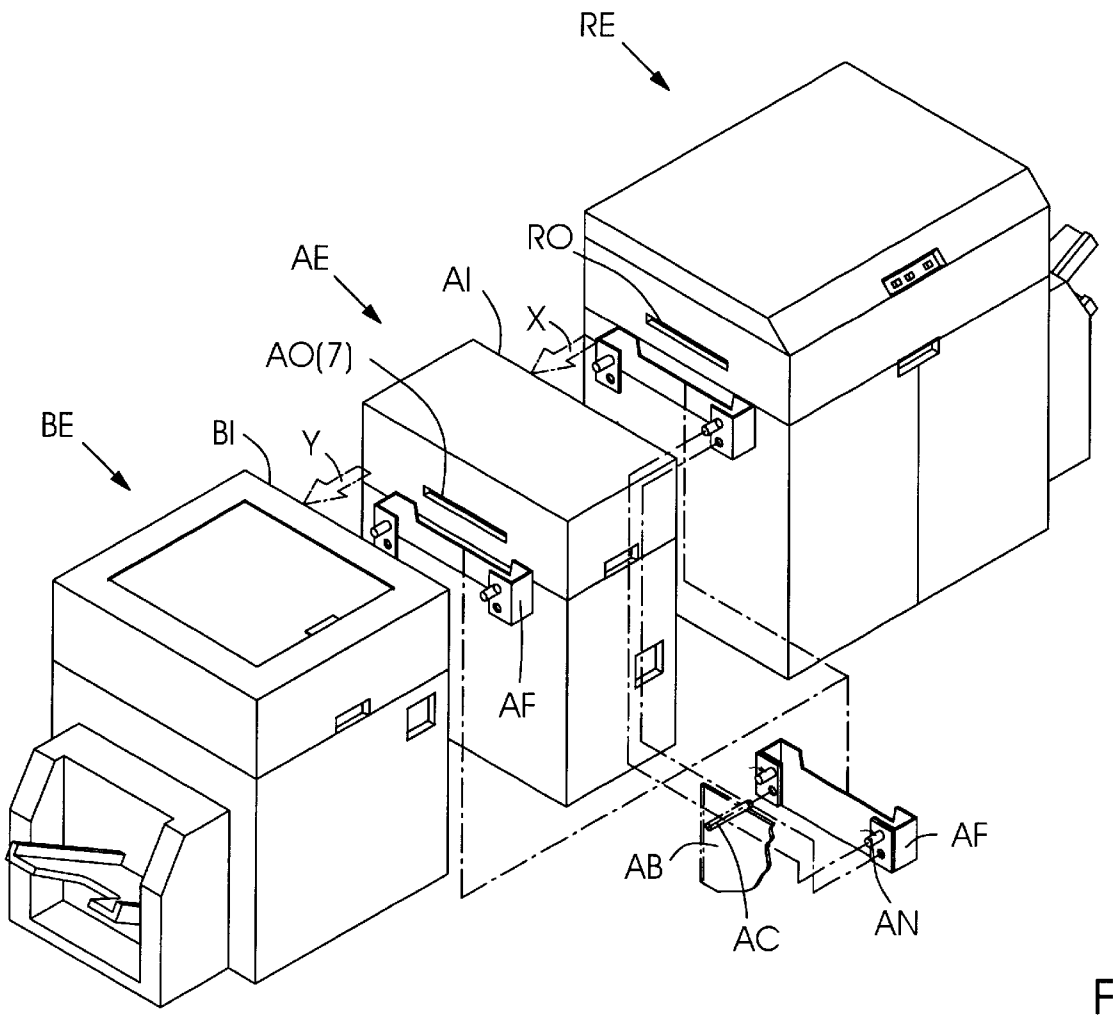
FIG. 1 presents an exploded isometric view of an apparatus including a device according to one aspect of the invention disposed between a xerographic reproduction unit and a finishing unit of a xerographic reproduction system.

Referring now specifically to FIG. 1, an aligning device AE according to one aspect of the invention is presented that is configured as a separate, replaceable unit mountable to and in between a printing device RE and a finishing device BE. The finishing device BE may be of a conventional type, for example a stapling device for sheets of printed materials. Likewise, the xerographic printing device RE may be of conventional type, for example a xerographic copier which produces a stream of sheets of printed materials S bearing a toner image. The sheets coming from the copier are aligned, by the aligning unit or aligning device AE, into a desired position before being transported to the stapling device. As will be described in more detail, the aligning device AE comprises at least one sheet inverting device.

The modular xerographic reproduction system shown in FIG. 1 has mechanical and electrical coupling elements, as are known in the art, for connecting the individual devices RE, AE, and BE, together. In the specific embodiment presented herein, coupling elements AB, AC, AF, AN provide mechanical adjustment. As presented in FIG. 1, for example, the coupling elements may comprise two centering pins AC, and/or a connecting bracket AF with two setting/mounting screws, attached to the front or rear housing wall AB, as may be needed. Electrical and control connections, not shown, are also provided. The coupling elements AB, AC, AF, and AN are configured to provide height adjustment of the printed material guideways entering and leaving the alignment device AE (indicated as 2 and 7, or Al and AO, in FIG. 2) to align with the material outlet slot RO on the reproduction device RE, and the material inlet slot BI on the finishing unit BE. A control apparatus may also be provided for controlling printed material transport speeds of the aligning unit AE to that of the xerographic reproduction unit RE and the finishing unit BE.

Figure 2:
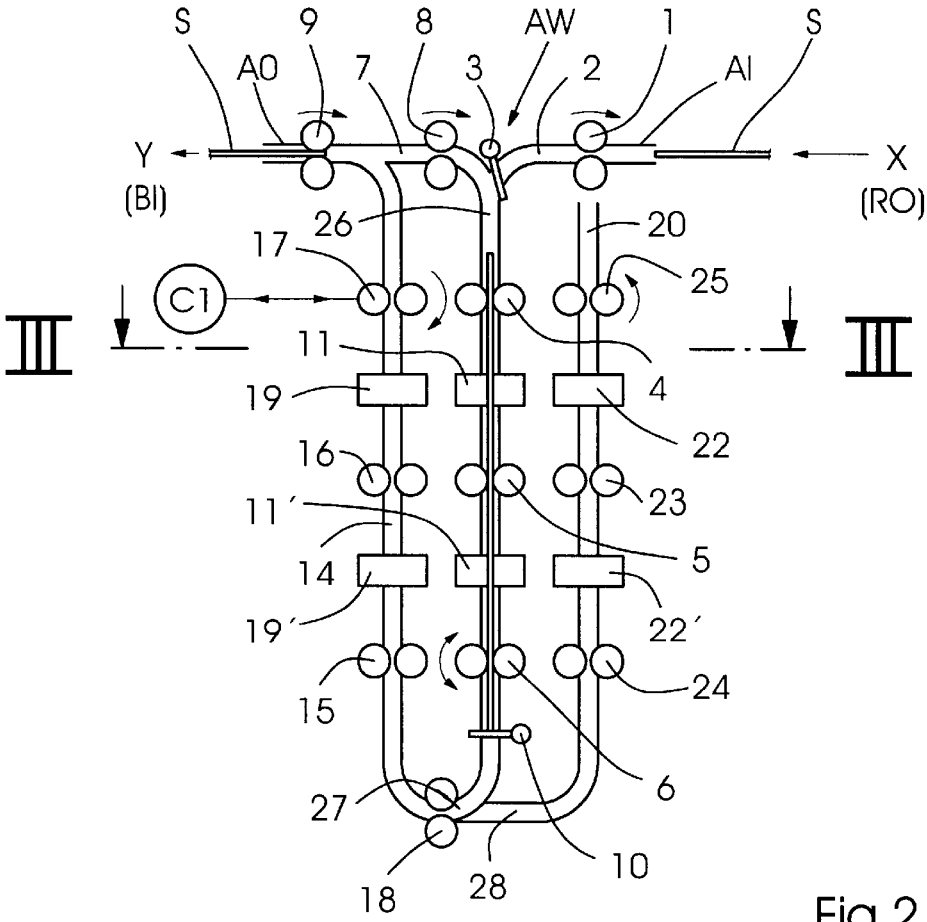
FIG. 2 presents a side enlarged view of a paper path and process according to one aspect of the invention, which may be implemented in the device of FIG. 1.
Figure 3:
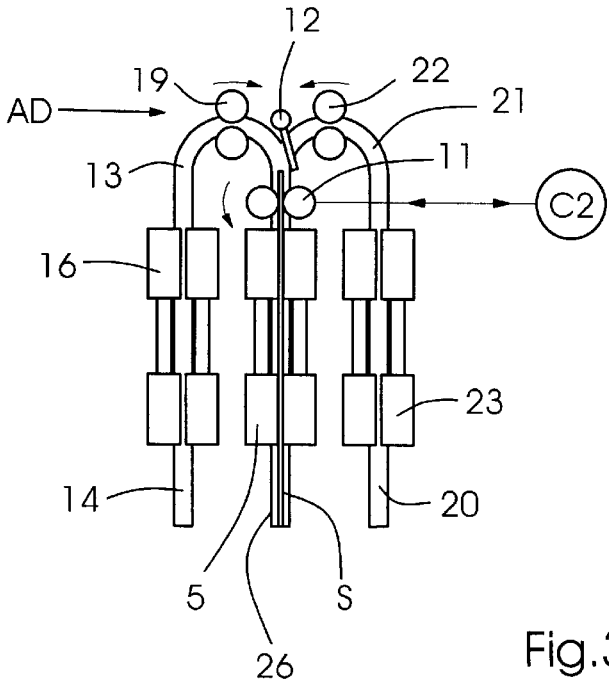
FIG. 3 presents a top view of the paper path of FIG. 2 when viewed as indicated along line III—III of FIG. 2.

Referring now to FIGS. 2 and 3, side and top views of a paper path are presented, respectively, that may be implemented in the alignment device AE. The paper path schematically illustrated in FIGS. 2 and 3, is equipped with an inverting device AD (FIG. 3) that inverts a sheet S side-for-side about one axis, and with a complementary inverting device AW (FIG. 2) that inverts a sheet S end-for end about a transverse axis. One or more sheet guideways may be provided that define transport axes that may be parallel or transverse to the axis about which a sheet is inverted. According to a further aspect of the invention, the alignment is carried out, as predetermined, in order to satisfy specific position requirements for the finishing device BE as shown in FIGS. 4*a* to 4*d*.

Referring now to FIGS. 4*a* through 4*d*, a printed sheet may be selectively aligned in any one of four positions. According to an aspect of the invention, the sheets of printed materials S can be inverted side-for-side using the inverting device AD, for example, by +/−180 degrees around a longitudinal axis LA. According to a further aspect of the invention, the sheets of printed materials S can be inverted end-for-end using the inverting device AW, for example by 180 degrees around a transverse axis QA.

As shown in FIGS. 2 and 3, the inverting device AD and complementary inverting device AW may be integrated with each other, and preferably form a single integrated unit.

Referring now specifically to FIG. 2, inverting device AW comprises a first pocket-shaped printed material holder comprising a guideway 26 that runs at a right angle to the transport direction X, Y. The guideways 2, 7 constitute a guideway that passes by the guideway 26. The guideways 2, 7 may run essentially horizontal in the transport direction X, Y. The guideway 26 may be connected to the printed material outlet AO or printed material inlet Al of the guideways 2, 7 by a first controllable two-way distributing guide 3. The guideways 2, 7 and 26 are equipped with several controllable transport devices 1, 4, 5, 6, 8, 9. A controllable stop 10 may be provided at the end of the guideway 26 opposite of the guideway(s) 2, 7. The guideway 26 is provided with transport devices 4, 5 and 6 as upper, center and lower transport devices and the guideway(s) 2 and 7 are provided with transport devices 1 and 8, 9. Each guideway defines a transport axis corresponding to that guideway, the direction in which the guideway transports a sheet.

In addition, the transport devices 4, 5, 6 of the inverting device AW can be operated forward and backward in a direction of rotation such that sheets of printed materials S transported from guideway 2 can be conveyed either downward in the direction of printed material stop 10 or upward to guideway 7 and to the transport devices 8 and 9.

The controllable printed material stop 10, as will be explained in greater detail in the following, may also be implemented as a component of the inverting device AD.

The inverting device AD comprises second and third pocket-shaped printed material holders comprising guideways 14, 20 that run plane-parallel to the guideway 26 with several transport devices 11, 11', 15, 16, 17, 18, 19, 19', 22, 22', 23, 24, 25. The guideways 14, 20 are connected with each other by way of first and second U-shaped guideways 13, 21 (best seen in FIG. 3). A second two-way distributing guide 12 may be provided at the juncture of the guideways 13, 21. The three guideways 14, 20, 26 are also connected at an end opposite the guideways 2, 7 by way of third and fourth U-shaped guideways 27, 28 (best seen in FIG. 2). The guideway 14 is connected to guideway 7 at an end opposite the guide channels 27 and 28.

In the embodiment of FIGS. 2 and 3, the transport devices 1, 4, 5, 6, 8, 9 of the inverting device AW are mounted so that they are aligned at a right angle to transport devices 11, 11'; 19, 19', 22, 22' of the inverting device AD. In addition, the transport devices 1, 4, 5, 6, 8, 9 and the transport devices 11, 11', 15, 16, 17, 18, 19, 19', 22, 22', 23, 23, 24, 25 can be operated alternately in succession, depending on the operation of the xerographic reproduction RE and finishing unit BE.

The transport devices may comprise pairs of transport rollers, each with a drive roller and a snubber roller. The transport devices can be driven by means of a conventional microprocessor-controlled drive unit, and the snubber rollers of the transport devices can be raised radially from the drive rollers by means of a conventional microprocessor-controlled lifting unit C1, C2.

According to a further aspect of the invention, a sheet aligning process in combination with a printing process is provided, comprising inverting a sheet about one or both of an axis with a sheet inverting device and another axis transverse to said axis with another sheet inverting device, the sheet inverting device and the another sheet inverting device being integrated with each other.

For example, referring to FIGS. 1–3, and assuming the copier RE outputs a printed material positioned shown in FIG. 4*d* (printed material aligned with the toner image facing down, and a toner image lower edge pointing in transport direction X toward Y, which orientation is determined by copier RE), the sheets of printed materials bearing the toner image may be transported with the same alignment, without inverting, to the finishing device BE as follows. The sheets of printed materials S coming out of the outlet slot RO of the copier RE are transported in direction X to the inlet slot Al of the aligning device AE and on its guideway 2 to the transport roller pair 1. The first two-way distributing guide 3 and stop 10 are positioned to open guideway 26 (if not already so positioned), which directs the sheets of printed materials S into the guideway 26 where the sheets are propelled by transport devices 4, 5, and 6. After that, the sheets S are propelled through the lower, U-shaped guideway 27 and through it to the transport roller pair 18 for the purpose of further transport of the sheets of printed materials into the second printed material holder 14. Here the transport devices 15, 16 and 17 of the guideway 14 and the transport roller pair 9 of guideway 7 take over the transport in direction Y to the outlet slot AO of the alignment unit AE, and to the inlet slot BI of the finishing device BE.

Figures 4A, 4B, 4C, 4D:
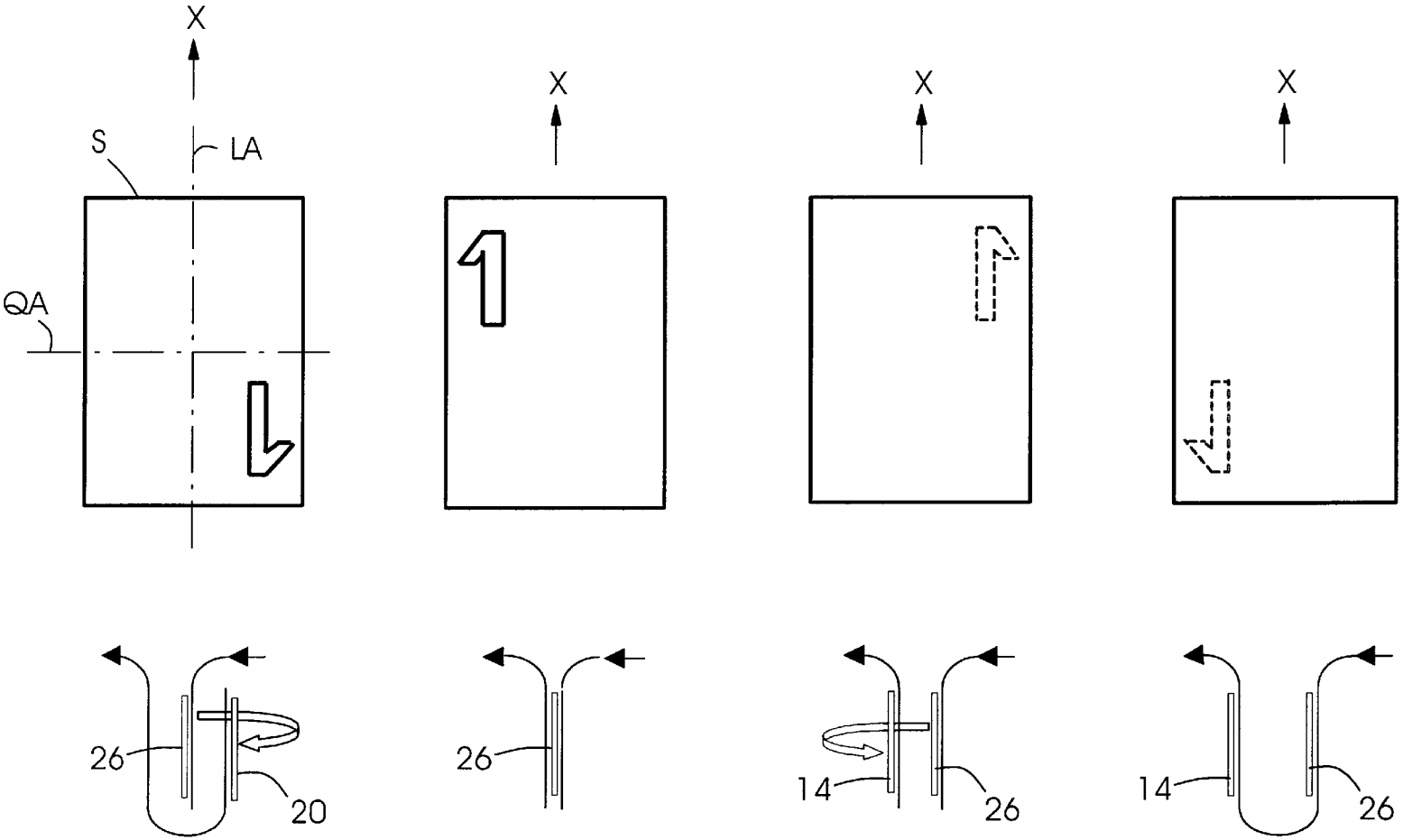
FIG. 4 presents alignments that can be carried out, according to a further aspect of the invention.

If a different printed material alignment is desired in the finishing device BE, for example that presented in FIG. 4*b*, inverting of the sheets of printed materials S is implemented. In this example, the sheets of printed materials S, are transported into the center printed material holder 26, as described above, but this time against the printed material stop 10 that is positioned in the guideway 26. Afterwards, the first two-way distributing guide 3 is switched such that the guideway 26 of the printed material holder 26 is connected to the guideway 7 and the direction of rotation of transport roller pairs 4, 5 & 6 is switched into the reverse direction of rotation in order to transport sheets of printed materials S to the outlet slot Al of the alignment unit with the use of transport rollers 8 and 9, in an alignment pursuant to FIG. 4*b*.

Further, according to this example, if the printed material alignment presented in FIG. 4*a* is desired in the finishing device BE, the sheets of printed materials S, are transported into the center printed material holder 26, as described above, and against the printed material stop 10 that positioned in the guideway 26. Then the transport roller pairs 4, 5 and 6 of the first printed material holder 26 and transport roller pairs 23, 24 and 25 of the third printed material holder 20 are switched off or disconnected from the drive unit and opened by means of the first lifting unit C1. Then the transport roller pairs 11, 11' and 22, 22' of the inverting device AD (see FIGS. 2 & 3) are closed by means of the second lifting unit C2 and driven by means of their drive unit so that sheet S is transported into the third guideway 20 laterally over the second U-shaped guideway 21 with appropriately positioned second two-way distributing guide 12. After the transport or rotation of the printed material is done, the transport roller pairs 11, 11' and 22, 22' are switched off and opened and after that, the transport roller pairs 15, 16, 17 and 23, 24, 25 are closed again and driven together with transport roller pairs 9 and 18 such that the sheets of printed materials S pass through the third and fourth U-shaped guide channels 28 and 27, through the second guideway 14, to guideway 7, and to outlet slot AO of the aligning unit AE in an alignment pursuant to FIG. 4*a*.

Finally, continuing with the example, if a printed material position as pursuant to FIG. 4*c* is desired, first the sheets of printed materials S, are transported into the center printed material holder 26, as described above, and against the printed material stop 10 positioned in the guideway 26. Then the transport roller pairs 4, 5 and 6 of the first printed material holder 26 and transport roller pairs 15, 16 and 17 of the second printed material holder 14 are disconnected from the drive unit and opened by means of the first lifting unit C1. Then the transport roller pairs 11, 11' and 19, 19' of the inverting device AD (see FIGS. 2 and 3) are closed by means of the second lifting unit C2 and driven by means of the drive unit so that the sheets of printed materials S are transported laterally over the first U-shaped guide channel 13 into the second guideway 14, with appropriately positioned two-way distributing guide 12. After the transport or inverting of the printed material is complete, the transport roller pairs 11, 11' and 19, 19' are switched off and opened and after that the transport roller pairs 15, 16, 17 are closed again and driven together with the transport roller pair 9 so that the sheets of printed materials S travel through the second guideway 14, to guideway 7, and to the outlet slot AO of aligning device AE and thereby to the finishing device BE in an alignment pursuant to FIG. 4*c*.

Although described in relation to a specific example, it is not intended to so limit the invention. Variations are evident, and may be required depending upon the application. The alignment of the sheet as it exits the printing device RE determines, in part, the control sequence. The alignment is further determined by the desired output from the finishing device BE.

Therefore, according to a further aspect of the invention, a sheet aligning process in combination with a printing process is provided, comprising inverting a sheet about one or both of an axis with a sheet inverting device and another axis transverse to said axis with another sheet inverting device, wherein the sheet inverting device and the another sheet inverting device are integrated with each other. Whether a sheet is to be inverted about one or both of said axis and said another axis is determined. For example, when implemented with a finishing device, whether a sheet is to be inverted about one or both of said axis and said another axis is determined according to an output desired from said finishing device. According to a further example, whether a sheet is to be inverted about one or both of said axis and said another axis is determined according to an output from the printing device and an output desired from the finishing device.

According to a further aspect of the invention, the aligning device AE is configured as a separate replaceable unit that can be used between the finishing unit and the xerographic reproduction unit of the xerographic reproduction system.

In an advantageous manner, aligning means are provided, on the one hand, in the device for rotating and, on the other hand, aligning means are provided for turning sheets of printed material bearing image and text, by means of which sheets of printed material can be aligned in accordance with predetermined position requirements of the finishing unit. In addition, means are provided in the device for mechanical adaptation and means for adapting the control system to the xerographic reproduction system, especially to the xerographic reproduction unit and the finishing unit.

In an advantageous manner, it is also possible, on the one hand, to rotate sheets of printed materials using rotating equipment +/−180 degrees around the longitudinal axis, parallel to the center axis of the guideway (also referred to herein as inverting end-for-end). On the other hand, it is possible to turn sheets of printed materials +/−180 degrees around their transversal axis along the direction of transport (also referred to herein as inverting side-for-side) by means of the turning equipment such that all the necessary printed material alignments can be carried out.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. A device for aligning sheets of printed materials of the type implemented with a printing device and a finishing device comprising at least one sheet inverting device and configured as a separate, replaceable unit mountable to and intermediate the printing device and the finishing device;

comprising said inverting device configured to invert about an axis, and another said inverting device configured to invert about another axis transverse to said axis.

2. The device according to claim 1, further comprising a sheet guideway defining a transport axis parallel with said axis, and said another axis is 90° relative to said axis.

3. The device according to claim 1, wherein said inverting device and said another inverting device are integrated with each other.

4. The device according to claim 1, further comprising a sheet guideway passing by said inverting device, transport devices configured to transport sheets along said sheet guideway, and a first controllable distributing guide that directs sheets into or out-of said inverting device from said sheet guideway, and a controllable sheet stop positionable to stop sheets within said inverting device.

5. The device according to claim 1, wherein said inverting device comprises a first guideway, and said another inverting device comprises a second guideway and a third guideway disposed on either side of said first guideway parallel thereto, a pair of U-shaped guideways connecting said first, second and third guideways for movement of sheets parallel to said axis, and another pair of U-shaped guideways connecting said first, second and third guideways for movement of sheets in said first, second, and third guideways parallel to said another axis.

6. The device according to claim 5, further comprising a controllable stop positionable to stop sheets received within said first guideway.

7. The device according to claim 1, wherein said inverting device comprises a transport device configured to transport a sheet in one of two opposite directions.

8. The device according to claim 7, wherein said transport device comprises a transport roller pair with a drive roller and a snubber roller, a microprocessor-controlled drive unit configured to drive said drive roller, and a microprocessor-controlled lifting unit configured to lift said snubber roller.

9. A device for aligning sheets of printed materials, of the type implemented with a printing device and a finishing device, comprising a sheet inverting device configured to invert about an axis, and another sheet inverting device configured to invert about another axis transverse to said axis, said sheet inverting device and said another sheet inverting device being integrated with each other.

10. The device according to claim 9, further comprising a sheet guideway passing by said inverting device, transport devices configured to transport sheets along said sheet guideway, and a first controllable distributing guide that directs sheets into or out-of said inverting device from said sheet guideway, and a controllable sheet stop positionable to stop sheets within said inverting device.

11. The device according to claim 9, wherein said inverting device comprises a first guideway, and said another inverting device comprises a second guideway and a third guideway disposed on either side of said first guideway parallel thereto, a pair of U-shaped guideways connecting said first, second and third guideways for movement of sheets within said first, second and third guideways parallel to said axis, and another pair of U-shaped guideways connecting said first, second and third guideways for movement of sheets within said first, second, and third guideways parallel to said another axis.

12. The device according to claim 11, further comprising a controllable stop positionable to stop sheets received within said first guideway.

13. The device of claim 9, wherein said axis and said another axis are 90° relative to each other.

14. A sheet aligning process in combination with a printing process, comprising:

inverting a sheet about one or both of an axis with a sheet inverting device and another axis transverse to said axis with another sheet inverting device;

said sheet inverting device and said another sheet inverting device being integrated with each other.

15. The process of claim 14, further comprising determining whether a sheet is to be inverted about one or both of said axis and said another axis.

16. The process of claim 14, further comprising a finishing device, and determining whether a sheet is to be inverted about one or both of said axis and said another axis according to an output desired from said finishing device.

17. The process of claim 14, further comprising a printing device and a finishing device, and determining whether a sheet is to be inverted about one or both of said axis and said another axis according to an output from said printing device and an output desired from said finishing device.

* * * * *